US006536765B1

(12) United States Patent
Thomas

(10) Patent No.: US 6,536,765 B1
(45) Date of Patent: Mar. 25, 2003

(54) MARBLE GAME

(76) Inventor: Paul A. Thomas, 126 Alice Duncan La., Estill Springs, TN (US) 37330-4168

( * ) Notice: Subject to any disclaimer, the term of this patent is extended or adjusted under 35 U.S.C. 154(b) by 0 days.

(21) Appl. No.: 10/116,913

(22) Filed: Apr. 8, 2002

(51) Int. Cl.[7] ..... A63F 3/00
(52) U.S. Cl. ..... 273/258; 273/248; 273/153 J
(58) Field of Search ..... 273/248, 243, 273/271, 287, 153 S, 153 J, 258

(56) References Cited

U.S. PATENT DOCUMENTS 3,709,497 A 1/1973 Barlow
3,762,714 A 10/1973 Wilson
4,978,128 A 12/1990 Holleman et al.
D337,353 S 7/1993 Marsh, Sr.

*Primary Examiner*—Benjamin H. Layno
*Assistant Examiner*—V K Mendiratta
(74) *Attorney, Agent, or Firm*—Donald R. Schoonover

(57) ABSTRACT

A marble game includes a game board in the form of a cruciform and requires a player to move marbles around a board, or to and from a center location. Each player is provided with five marbles and the first player to move all five marbles either to and from the center location, or around the board wins the game. Some marbles have to be returned to a home position during the game when certain occurrences happen.

4 Claims, 4 Drawing Sheets

10
12
14
16
18
20
22
24
26
28
30
32
34
36
38
40
42
44
46
48
50
52
54
56
58

42

D1
D2
D3
D4

W1
W2
W3
W4

MARBLE GAME

BACKGROUND OF THE INVENTION

1. Field of the Invention

The present invention relates to the general art of games, and to the particular field of marble games.

2. Discussion of the Related Art

Board games and parlor games have been a part of society for many years and there are numerous examples of such games. One particularly popular form of such games involves the use of marbles. There are several marble games that involve a high degree of skill and strategy. However, some of these games may be difficult to master and, while learning, a player may lose more often than he or she wins. This can be frustrating and may cause a player to stop playing the game until he or she achieves sufficient skill to make the game enjoyable.

Therefore, there is a need for a game that is amenable to a wide variety of uses and players.

Furthermore, to permit a player to begin enjoying a game as quickly as possible, there is a need for a game that has rules that can be understood and followed by players having a wide range of skills.

Once a player masters a game and its rules and nuances, that player may be able to win on a consistent basis. Such a player may not enjoy playing someone who is just learning the game and vice versa. However, many games can be enjoyed by a parent playing with a child. However, if the parent has skills far above the child's skills, the game may not be enjoyable for either player. The difference in skills often shows up in the strategy used by a player. A skilled player may use strategy that is so subtle, the other player does not even realize it and does not understand why he or she consistently loses. This can be frustrating and off-putting.

Therefore, there is a need for a game that includes strategy, but where the strategy is not so sophisticated that young children will be excluded from the game.

Often, games are used as entertainment at parties. However, many players in such situations may have never played the game before. Thus, time is expended in teaching these players the game and its rules. If the rules are long and complex, it may take so long to teach a new player the game that it is not worth the time spent and the game is not played. This is a drawback to many games.

Therefore, there is a need for a game that is quickly learned.

Often, a game must be played quickly in order to maintain interest or because of time constraints. At other times, however, if time is not a consideration, a game is best enjoyed if it takes a while to complete the game. Some games are not amenable to such variation in time of play and thus have a disadvantage of not being playable at all times.

Therefore, there is a need for a game that can be played quickly or in a manner that takes some time to complete a single game.

PRINCIPAL OBJECTS OF THE INVENTION

It is a main object of the present invention to provide a game that is amenable to a wide variety of uses and players.

It is another object of the present invention to provide a game that has rules that can be understood and followed by players having a wide range of skills.

It is another object of the present invention to provide a game that includes strategy, but the strategy is not so sophisticated that young children will be excluded from the game.

It is another object of the present invention to provide a game that is quickly learned.

It is another object of the present invention to provide a game that can be played quickly or in a manner that takes some time to complete a single game.

SUMMARY OF THE INVENTION

These, and other, objects are achieved by a board game that is played using marbles and which has rules that can be understood and followed by players having a wide range of skills. The game includes strategy, but the strategy is not so sophisticated that young children will be excluded from the game, yet the presence of strategy will provide interest to adults. The game is also quickly learned so people can be playing the game at a high level very quickly. This will permit the game to be a party game. The game can be played quickly or in a manner that takes some time to complete a single game; therefore, the game will be amenable to a wide variety of uses.

DETAILED DESCRIPTION OF THE INVENTION

Figure 1:
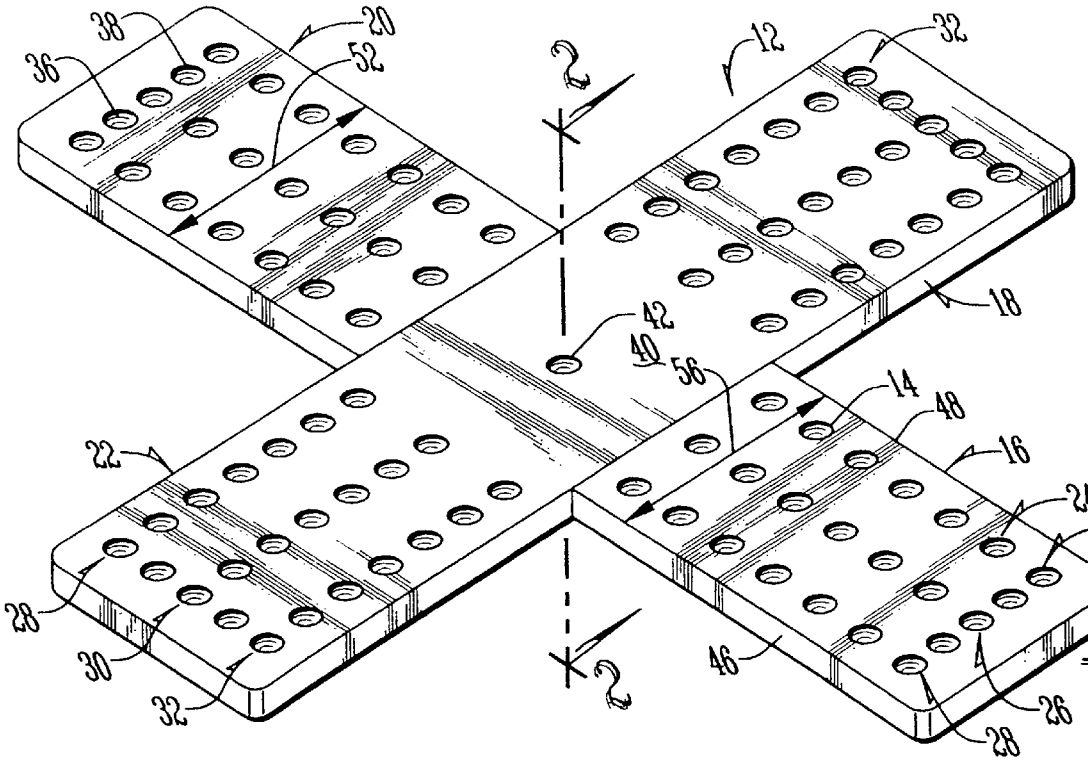
FIG. 1 is a perspective view of a game board used in the game embodying the present invention.

Other objects, features and advantages of the invention will become apparent from a consideration of the following detailed description and the accompanying drawings.

As shown in FIGS. 1–4, the game embodying the present invention includes a game board 12 having a multiplicity of dimples, such as dimple 14, defined therein, four player sections 16, 18, 20 and 22, with each player being associated with one player section. Dimples 14 are arranged in seven rows, such as row 24, and three columns, such as column 26, on each player section of the four player sections. Each of the columns 26 includes a first column 28, a second column 30, and a third column 32. One row 34 of dimples on each player section has five dimples therein with two of the dimples, dimples 36 and 38, in row 34 of five dimples not being associated with a column of dimples.

Figure 2:
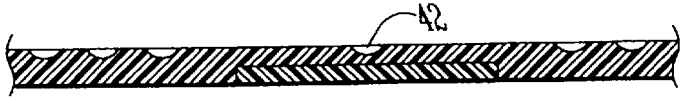
FIG. 2 is a cross sectional view taken along line 2—2 of FIG. 1.
Figure 3:
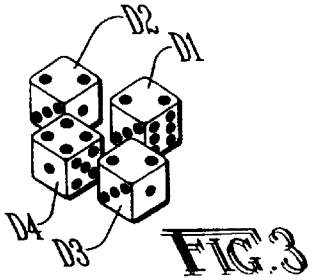
FIG. 3 illustrates marbles used in the game, with each player being provided five marbles.

Game board 12 further includes a center section 40 which has a center dimple 42 defined therein, and is square in shape. The center section need not be a separate element but can be a continuation of one or more of the player sections as indicated in FIG. 2, but for the sake of description, it will be referred to as being square.

Each player section is rectangular in shape and includes two side edges 46 and 48 and an end edge 50, and has a width dimension 52 being defined between the two side edges 46, 48. Width dimension 52 of each player section is equal to length 56 of each side of the square shaped center section 40. Again, as above, the player sections need not be rectangular as indicated in FIGS. 1 and 2, but for the sake of description will be referred to as rectangles.

The player sections are arranged to have one player section adjacent to each side of the square center section 40 to define a cruciform shape as shown in FIG. 1.

First column 28 of each player section is located adjacent to one side edge of the each player section, and third column 32 of each player section is located adjacent to another side edge of each player column. Second column 30 of each player section is located between the first and third columns 28, 32 of each player section as shown in FIG. 1.

The game board 12 can be formed of plastic or any other suitable material and can be dismantled for storage.

Figures 5A, 5B:
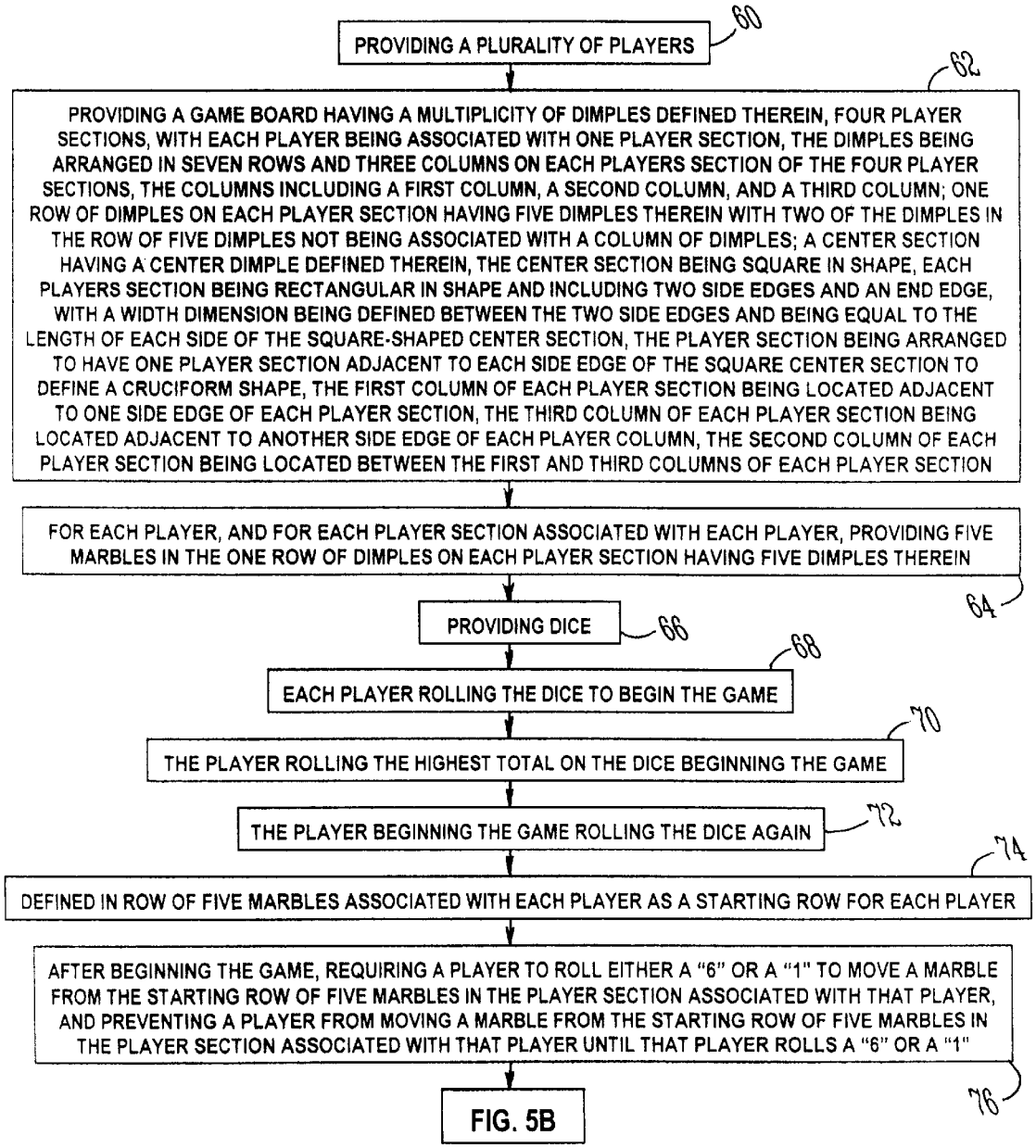
FIG. 5 illustrates the method embodying the present invention.
Figure 5B:
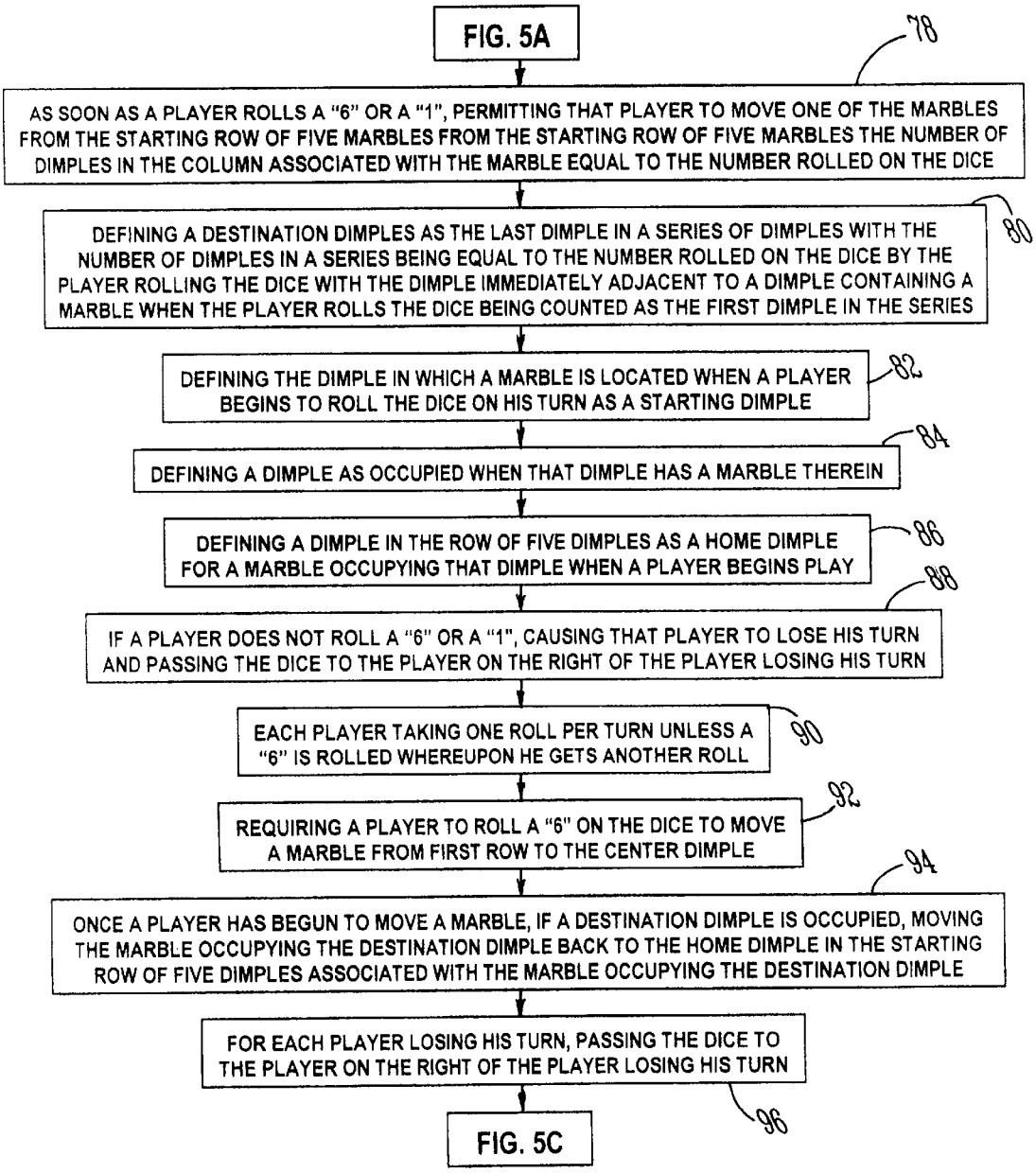
Figure 5C:
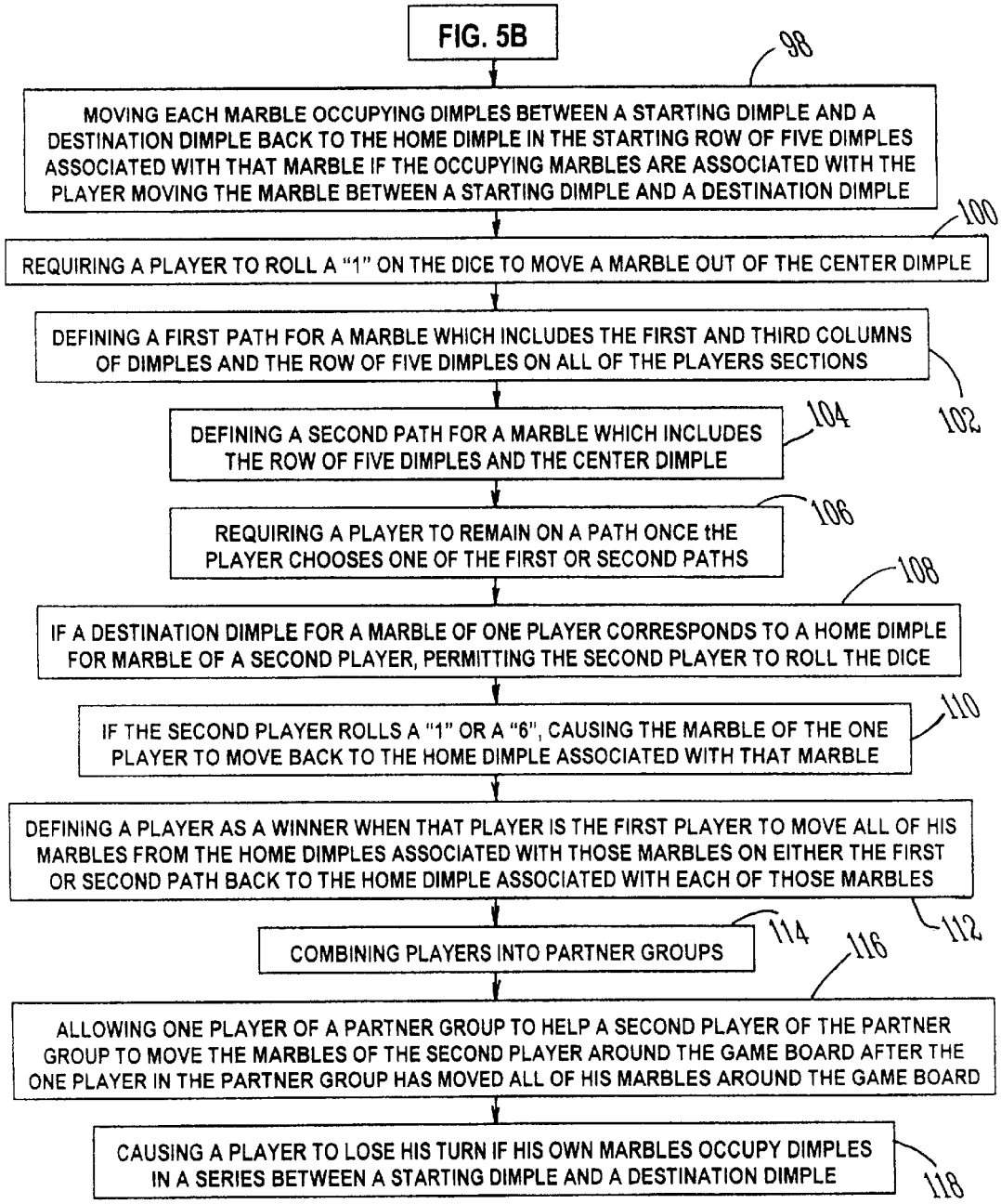

The game is played according to the method illustrated in FIG. 5 and includes the following steps.

Providing a plurality of players in step 60 which, in the form shown, includes up to four players.

In step 62, providing the game board 12 described above.

In step 64, for each player, and for each player section associated with each player, providing five marbles in the one row of dimples on each player section having five dimples therein. The five marbles are shown for each player in FIG. 3 as marble sets M1–M4 with each marble set including five marbles. The marbles can be colored and each set of marbles can have its own distinctive color. Each player section can have a color and the colors for the player sections can correspond to the colors of the marbles in a marble set. This will allow the players to keep track of their marbles as the marbles move around the board 12.

Figure 4:
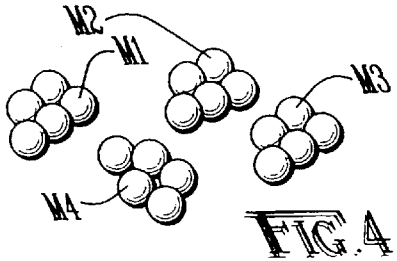
FIG. 4 illustrates dice that are used in the game of the present invention.

In step 66, providing dice which, in one form of the game, can be dice for each player as indicated in FIG. 4 by dice D1–D4. The dice can be colored to match or correspond to the colors of the marbles or the player sections.

Each player rolling the dice to begin the game in step 68.

The player rolling the highest total on the dice beginning the game in step 70.

The player beginning the game rolling the dice again in step 72.

In step 74, defining a row 34 of five marble associated with each player as a starting row for each player.

After beginning the game, in step 76, requiring a player to roll either a "6" or a "1" to move a marble from the starting row of five marbles in the player section associated with that player, and preventing a player from moving a marble from the starting row of five marbles in the player section associated with that player until that player rolls a "6" or a "1".

As soon as a player rolls a "6" or a "1", in step 78, permitting that player to move one of the marbles, from the starting row of five marbles, from the starting row of five marbles the number of dimples in the column associated with the marble equal to the number rolled on the dice.

In step 80, defining a destination dimple as the last dimple in a series of dimples, with the number of dimples in a series being equal to the number rolled on the dice by the player rolling the dice, with the dimple immediately adjacent to a dimple containing a marble when the player rolls the dice, being counted as the first dimple in the series.

In step 82, defining the dimple in which a marble is located when a player begins to roll the dice on his turn as a starting dimple.

In step 84, defining a dimple as occupied when that dimple has a marble therein.

In step 86, defining a dimple in the row of five dimples as a home dimple for a marble occupying that dimple when a player begins play.

If a player does not roll a "6" or a "1", in step 88, causing that player to lose his turn and passing the dice to the player on the right of the player losing his turn.

Each player taking one roll per turn in step 90, unless a player rolls a "6" whereupon that player gets another roll.

Step 92 requires a player to roll a "6" on the die to move a marble from first row to center dimple 42.

In step 94, once a player has begun to move a marble, if a destination dimple is occupied, moving the marble occupying the destination dimple back to the home dimple in the staring row of five dimples associated with the marble occupying the destination dimple.

As shown for step 96, for each player losing his turn, passing the dice to the player on the right of the player losing his turn.

In step 98, moving each marble occupying dimples between a starting dimple and a destination dimple back to the home dimple in the starting row of five dimples associated with that marble if the occupying marbles are associated with the player moving the marble between a starting dimple and a destination dimple.

Step 100 requires a player to roll a "1" on the dice to move a marble out of the center dimple.

Defining, in step 102, a first path for a marble which includes the first and third columns of dimples and the rows of five dimples on all of the player sections, and step 104 requires defining a second path for a marble which includes the row of five dimples and the center dimple. Step 106 requires a player to remain on a path once the player chooses one of the first or second paths.

In step 108, if a destination dimple for a marble of one player corresponds to a home dimple for a marble of a second player, permitting the second player to roll the dice and, in step 110, if the second player rolls a "1" or a "6", causing the marble of the one player to move back to the home dimple associated with that marble.

In step 112, defining a player as a winner when that player is the first player to move all of his marbles from the home dimples associated with those marbles on either the first or the second path back to the home dimple associated with each of those marbles.

Variations of the game include playing with partners. In such case, the method of the game will include a step 114 of allowing one player of a partner group to help a second player of the partner group to move the marbles of the second player around the game board after the one player in the partner group has moved all of his marbles around the game board, and step 116 includes causing a player to lose his turn if his own marbles occupy dimples in a series between a starting dimple and a destination dimple. This can be a step that is included for either form of the game, and can be used when one partner of a partner group must jump over his partner's marbles.

It is understood that while certain forms of the present invention have been illustrated and described herein, it is not to be limited to the specific forms or arrangements of parts described and shown.

I claim:

1. A method of playing a game comprising:

a) providing a plurality of players;

b) providing a game board having (1) a multiplicity of dimples defined therein, (2) four player sections, with each player being associated with one player section, (3) the dimples being arranged in seven rows and three columns on each player section of the four player sections, the columns including a first column, a second column, and a third column, (4) one row of dimples on each player section having five dimples therein with two of the dimples in the row of five dimples not being associated with a column of dimples;

(5) a center section having a center dimple defined therein, (6) the center section being square in shape, (7) each player section being rectangular in shape and including two side edges and an end edge, with a width dimension being defined between the two side edges and being equal to the length of each side of the square-shaped center section, (8) the player sections being arranged to have one player section adjacent to each side of the square center section to define a cruciform shape, (9) the first column of each player section being located adjacent to one side edge of each player section,

(10) the third column of each player section being located adjacent to another side edge of each player column, and

(11) the second column of each player section, being located between the first and third columns of each player section, the finish column;

c) for each player, and for each player section associated with each player, providing five marbles in the one row of dimples on each player section having five dimples therein;

d) providing dice;

e) each player rolling the dice to begin the game;

f) the player rolling the highest total on the dice beginning the game;

g) the player beginning the game rolling the dice again;

h) defining the row of five marble associated with each player as a starting row for each player;

i) after beginning the game, requiring a player to roll either a "6" or a "1" to move a marble from the starting row of five marbles in the player section associated with that player, and preventing a player from moving a marble from the starting row of five marbles in the player section associated with that player until that player rolls a "6" or a "1", with the player being allowed to roll again if a "6" is rolled;

j) as soon as a player rolls a "6" or a "1", permitting that player to move one of the marbles from the starting row of five marbles from the starting row of five marbles the number of dimples in the column associated with the marble equal to the number rolled on the dice;

k) defining a destination dimple as the last dimple in a series of dimples with the number of dimples in a series being equal to the number rolled on the dice by the player rolling the dice with the dimple immediately adjacent to a dimple containing a marble when the player rolls the dice being counted as the first dimple in the series;

l) defining the dimple in which a marble is located when a player begins to roll the dice on his turn as a starting dimple;

m) defining a dimple as occupied when that dimple has a marble therein;

n) defining a dimple in the row of five dimples as a home dimple for a marble occupying that dimple when a player begins play;

o) if a player does not roll a "6" or a "1", causing that player to lose his turn and passing the dice to the player on the right of the player losing his turn;

p) each player taking one roll per turn unless he rolls a "6" whereupon he gets another roll;

q) requiring a player to roll a "1" on the die to move a marble from a row to the center dimple;

r) once a player has begun to move a marble, if a destination dimple is occupied, moving the marble occupying the destination dimple back to the home dimple in the staring row of five dimples associated with the marble occupying the destination dimple;

s) for each player losing his turn, passing the dice to the player on the right of the player losing his turn;

t) moving each marble occupying dimples between a starting dimple and a destination dimple back to the home dimple in the starting row of five dimples associated with that marble if the occupying marbles are associated with the player moving the marble between a starting dimple and a destination dimple;

u) requiring a player to roll a "1" on the dice to move a marble out of the center dimple;

v) defining a first path for a marble which includes the first and third columns of dimples and the rows of five dimples on all of the player sections;

w) defining a second path for a marble which includes the row of five dimples and the center dimple;

x) requiring a player to remain on a path once the player chooses one of the first or second paths;

y) if a destination dimple for a marble of one player corresponds to a home dimple for a marble of a second player, permitting the second player to roll the dice;

z) if the second player rolls a "1" or a "6", causing the marble of the one player to move back to the home dimple associated with that marble;

aa) defining a player as a winner when that player is the first player to move all of his marbles from the home dimples associated with those marbles on either the first or the second path back to the home dimple associated with each of those marbles.

2. The method as described in claim 1 further including a step of combining players into partner groups.

3. The method as described in claim 2 further including a step of allowing one player of a partner group to help a second player of the partner group to move the marbles of the second player around the game board after the one player in the partner group has moved all of his marbles around the game board.

4. The method as described in claim 1 further including a step of causing a player to lose his turn if his own marbles occupy dimples in a series between a starting dimple and a destination dimple.

* * * * *